US009478843B2

(12) United States Patent
Tang et al.

(10) Patent No.: US 9,478,843 B2
(45) Date of Patent: Oct. 25, 2016

(54) DIELECTRIC WAVEGUIDES SPLITTER AND HYBRID/ISOLATOR FOR BIDIRECTIONAL LINK

(71) Applicant: California Institute of Technology, Pasadena, CA (US)

(72) Inventors: Adrian Joseph Tang, Pasadena, CA (US); Goutam Chattopadhyay, Pasadena, CA (US); Nacer E. Chahat, Pasadena, CA (US); Emmanuel Decrossas, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 14/626,757

(22) Filed: Feb. 19, 2015

(65) Prior Publication Data

US 2015/0236396 A1 Aug. 20, 2015

Related U.S. Application Data

(60) Provisional application No. 61/941,886, filed on Feb. 19, 2014.

(51) Int. Cl.
*H01P 5/12* (2006.01)
*H01P 5/18* (2006.01)

(52) U.S. Cl.
CPC ..... *H01P 5/188* (2013.01); *H01P 5/12* (2013.01); *Y10T 29/49016* (2015.01)

(58) Field of Classification Search
CPC ..... H01P 3/16; H01P 11/006; H01P 5/12; H01P 5/188; Y10T 29/49016
USPC ..... 333/109
See application file for complete search history.

(56) References Cited

U.S. PATENT DOCUMENTS 4,307,938 A * 12/1981 Dyott ..... G02B 6/105 385/11
6,057,747 A * 5/2000 Takenoshita ..... H01P 1/02 333/137

(Continued)

FOREIGN PATENT DOCUMENTS

EP 0318198 A1 * 5/1989 ..... H01P 3/16

OTHER PUBLICATIONS

Emami, S., et al., "A 60GHz CMOS Phased-Array Transceiver Pair for Multi-Gb/s Wireless Communications", IEEE International Solid-State Circuits Conference, 2011, pp. 164-166.

(Continued)

*Primary Examiner* — Robert Pascal
*Assistant Examiner* — Kimberly Glenn
(74) *Attorney, Agent, or Firm* — Gates & Cooper LLP

(57) ABSTRACT

A system, method, device, and apparatus provide a dielectric waveguide splitter/bi-directional link. A dielectric substrate fabricated into a first Y-junction waveguide with a first port splitting into a first branch leading to a second port and a second branch leading to a third port. An angle between the first branch and the second branch is below ninety degrees (90°). The dielectric waveguide splitter enables millimeter-wave (mmWave) transmission between the first port and the second port while reducing feedback of the mmWave between the second and third port. Two Y-junction waveguides may be fabricated back-to-back to provide simultaneous bidirectional mmWave transmission at a single frequency.

19 Claims, 8 Drawing Sheets

(56) References Cited

U.S. PATENT DOCUMENTS

| | | | | |
|---|---|---|---|---|
| 7,808,439 | B2 * | 10/2010 | Yang | H01P 3/121 343/770 |
| 7,876,180 | B2 * | 1/2011 | Uchimura | H01P 1/122 333/239 |
| 2014/0312987 | A1 * | 10/2014 | Morita | H01P 3/121 333/137 |
| 2015/0109070 | A1 * | 4/2015 | Herbsommer | H01P 3/16 333/125 |

OTHER PUBLICATIONS

Hertel, P., "Dielectric Waveguides", Lectures delivered at TEDA Applied Physics School, Nankai University, Tianjin, PRC, Sep. 2009.

Kim, Y., et al., "An 8Gb/s/pin 4pJ/b/pin Single-T-Line Dual (Base+RF) Band Simultaneous Bidirectional Mobile Memory I/O Interface with Inter-Channel Interference Suppression", International Solid-State Circuits Conference 2012, Session 2, pp. 50-52.

Mitomo, T., et al., "A 2Gb/s-Throughput CMOS Transceiver Chipset with In-Package Antenna for 60GHz Short-Range Wireless Communication", Proc. International Solid-State Circuits Conference 2012, Session 15, pp. 266-267.

Natarajan, A., et al., "A Fully-Integrated 16-Element Phased-Array Receiver in SiGe BiCMOS for 60-GHz Communications", IEEE Journal of Solid-State Circuits, vol. 46, No. 5, pp. 1059-1075, May 2011.

Tanaka, Y., et al., "A Versatile Multi-Modality Serial Link", International Solid-State Circuits Conference 2012, Session 19, pp. 332-334.

Tang, A., et al., "A 155 GHz 220mW Synthesizer-Free Phase Based Radar System in 65nm CMOS Technology", IEEE International Microwave Symposium, 2013.

"Dielectric", Wikipedia, last modified Nov. 22, 2014. http://en.wikipedia.org/wiki/Dielectric.

"Dielectric-Material", Whatls.com, last modified Nov. 4, 2010. http://whatis.techtarget.com/definition/dielectric-material?vgnextfmt=print.

Low-voltage differential signaling, Wikipedia, last modified Dec. 10, 2014. http://en.wikipedia.org/wiki/Low-voltage_differential_signaling.

Chapter 5—Dielectric waveguides, Photonics Research Group. Last accessed by Wayback Machine on Oct. 29, 2013. http://photonics.intec.ugent.be/download/ocs131.pdf.

* cited by examiner

DIELECTRIC WAVEGUIDES SPLITTER AND HYBRID/ISOLATOR FOR BIDIRECTIONAL LINK

CROSS-REFERENCE TO RELATED APPLICATIONS

This application claims the benefit under 35 U.S.C. Section 119(e) of the following and commonly-assigned U.S. provisional patent application(s), which is/are incorporated by reference herein:

Provisional Application Ser. No. 61/941,886, filed on Feb. 19, 2014, by Adrian J. Tang, Goutam Chattopadhyay, Nacer E. Chahat, and Emmanuel Decrossas, entitled "Dielectric Waveguide Signal Splitter and Combiner for Future Gb/s Network Infrastructure".

STATEMENT REGARDING FEDERALLY SPONSORED RESEARCH AND DEVELOPMENT

The invention described herein was made in the performance of work under a NASA contract and is subject to the provisions of Public Law 96-517 (35 USC 202) in which the Contractor has elected to retain title.

BACKGROUND OF THE INVENTION

1. Field of the Invention

The present invention relates generally to network communication, and in particular, to a method, apparatus, system, and article of manufacture for splitting dielectric waveguides and enabling bidirectional communication across a dielectric waveguide in a millimeter wavelength communication system.

2. Description of the Related Art (Note: This application references a number of different publications as indicated throughout the specification by reference numbers enclosed in brackets, e.g., [x]. A list of these different publications ordered according to these reference numbers can be found below in the section entitled "References." Each of these publications is incorporated by reference herein.)

Advances in the mobile, desktop, and server backplane/data center markets have motivated new approaches to Gbps (gigabytes per second) interconnects that seek to reduce power consumption, increase data-reach (operating distance), and reduce overall package pin count. More specifically, millimeter-wave (mm-wave) communications have gained attention in recent years, primarily since the high fractional bandwidth potentially offers multi-Gb/s wireless data-links [1-3].

One recent Gbps solution proposed by wide-screen LCD (liquid crystal display) manufacturers are dielectric waveguides operating at mm-wave. These interconnects have been proposed as an alternative to conventional LVDS (low voltage differential signaling) or optical interconnects for transfer of HD (high definition) display data from the DVR (digital video recorder) or set-top box to the display processor. A dielectric waveguide is a long solid piece of dielectric that confines an electromagnetic wave and offers low insertion loss compared with copper solutions for LVDS (TP [twisted pair], CPW [coplanar waveguide], or uStrip).

Further, recently demonstrated mm-wave transceivers offer impressively high data-rates, however, their range is typically limited to only a few meters [2], and so non-free space mm-wave communication approaches such as the dielectric ribbon link demonstrated in [4] have been developed to operate over longer distances of up to 10 meters. Dielectric ribbons allow direct coupling from a transceiver with either an on-chip probe or antenna structure placed nearby the ribbon's end. The simplicity of coupling makes them attractive for aircraft and spacecraft applications as transmission through a dielectric ribbon does not rely on an electrical contact, only a coupled wave. Additionally dielectric ribbons can be much lighter weight than copper interconnects, reducing overall payload weight.

In view of the above, while dielectric waveguide interconnects themselves already exist, the necessary infrastructure (especially signal splitters and signal combiners) required to build modern network technologies have not yet been demonstrated. Accordingly, it is desirable to have a very simple, versatile, and flexible, transmission medium at relatively low costs, that offers mechanical interfacing similar to fiber optic, and channel bandwidths comparable to LVDS.

SUMMARY OF THE INVENTION

Embodiments of the invention provide a dielectric waveguide based power splitter (e.g., a dielectric ribbon system) that enables multi-cast operation (transmitting a signal from one-node to many nodes) and multi-listen (one-node receiving signals from many nodes). Such a splitter allows modern network topologies (star, ring, etc.) to be implemented and enables the dielectric waveguide to enter the network infrastructure market. Further, while the commercial market is driven by high data-rates, embodiments of the invention may be more modest, operating at data rates of 10 Mb/s which is comparable with the typical signaling interfaces found in aircraft or spacecraft systems.

Additional embodiments of the invention provide a hybrid/isolator component that allows for simultaneous bidirectional communication on a single dielectric waveguide cable (ribbon or tube) by preventing self-transmission (transmitting to the same-node receiver) through geometric manipulation of the signal.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Dielectric Waveguides Splitter

Figure 1:
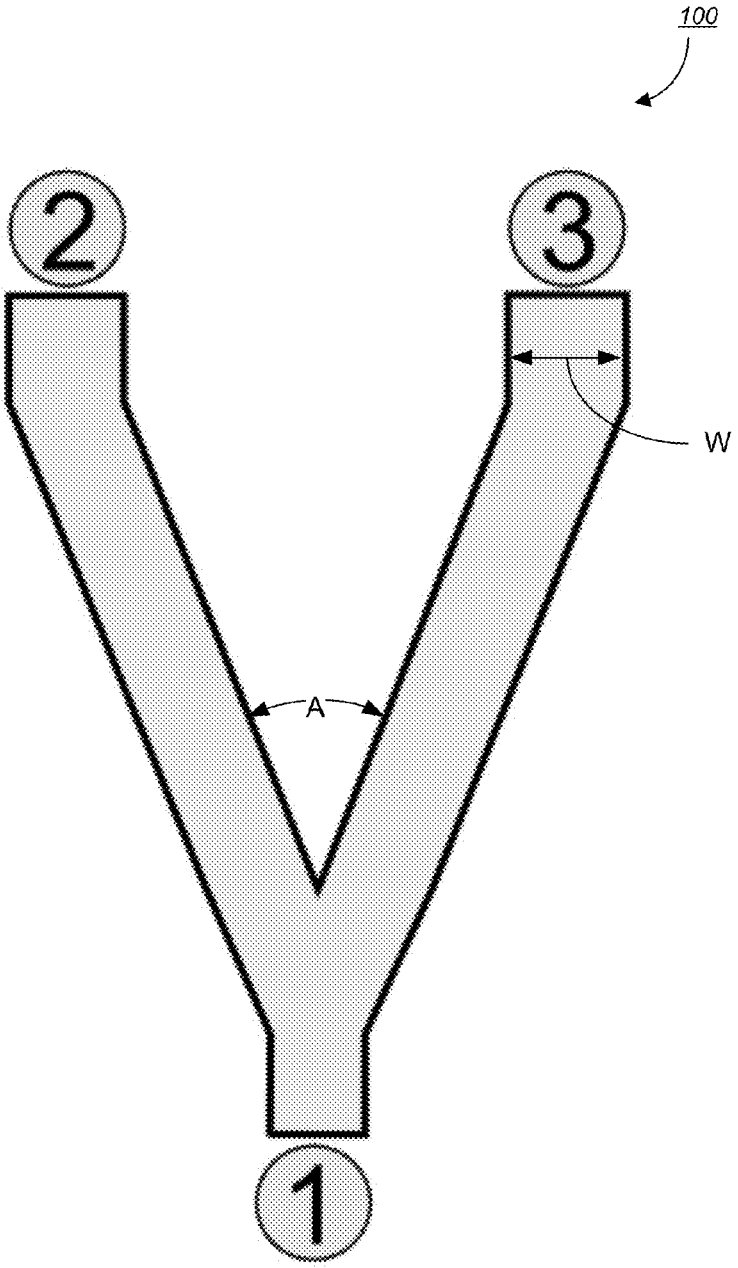
FIG. 1 illustrates a dielectric waveguide Y-junction power divider that may be utilized in accordance with one or more embodiments of the invention.

A dielectric waveguide entirely made of plastic (or other dielectric material) can be used to transfer data or power with low insertion loss. However, to split the power from one (1) port to two (2) ports, a dielectric waveguide power divider is required. FIG. 1 illustrates a dielectric waveguide Y-junction power divider that may be utilized in accordance with one or more embodiments of the invention. As illustrated, the power divider 100 splits the signal received from one input port (1) to two output ports (2 and 3). Of course, multiple such power dividers 100 can be combined to feed N output ports.

In one or more embodiments of the invention, the dielectric waveguide Y-junction power divider 100 is made entirely of plastic (or other dielectric material) with no metallization. The dielectric waveguide is not restricted to plastic substrate but may be any type of substrate (e.g. conventional substrate, polymer, fabric, dielectric foam, etc.). In this regard, various properties/characteristics of the dielectric waveguide power divider 100 enables the splitter/divider to function properly. More specifically, the angle A and sizing (e.g., width W) of the divider 100 may enable the power divider 100 to function as desired. In an electrical cable (e.g., a coaxial cable), if the size of the conductors is changed, nothing happens to the propagation. However, if the dimensions of a plastic/dielectric cable are changed, it may not function properly. In the dielectric waveguide Y-junction power divider 100, the angle A may be required to be less than 90°. Such an angle A permits the a mm (millimeter) wave signal to propagate from input port 1 to output ports 2 and 3 as desired.

Figure 2:
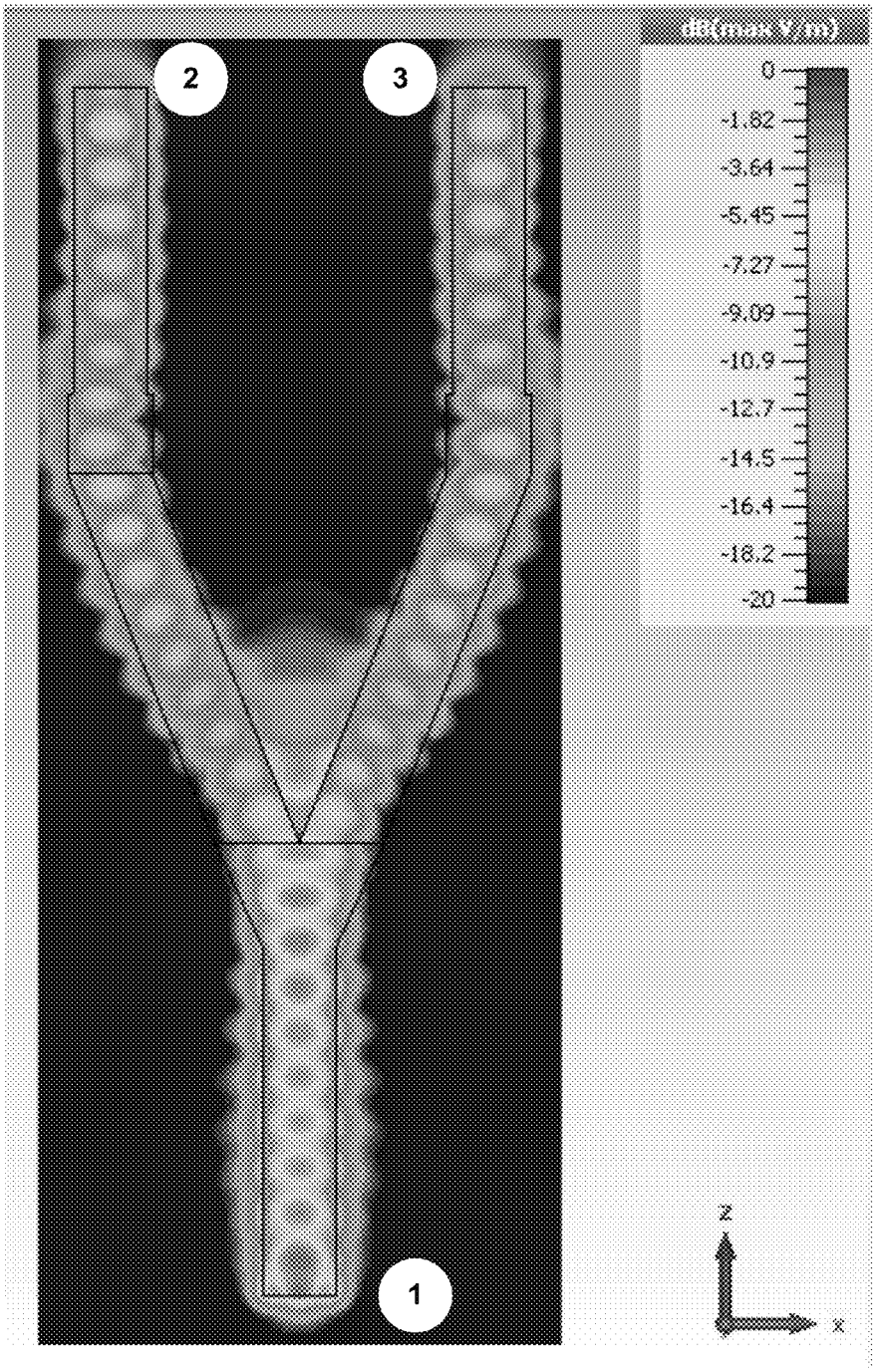
FIG. 2 illustrates a simulated field distribution on the dielectric waveguide Y-junction power divider of FIG. 1 in accordance with one or more embodiments of the invention.

An example of an optimized dielectric waveguide splitter is shown in FIG. 2. In this regard, FIG. 2 illustrates a simulated field distribution on the dielectric waveguide Y-junction power divider of FIG. 1. As illustrated, the electric field is split relatively evenly from the input port 1 to the output ports 2 and 3.

Figure 3:
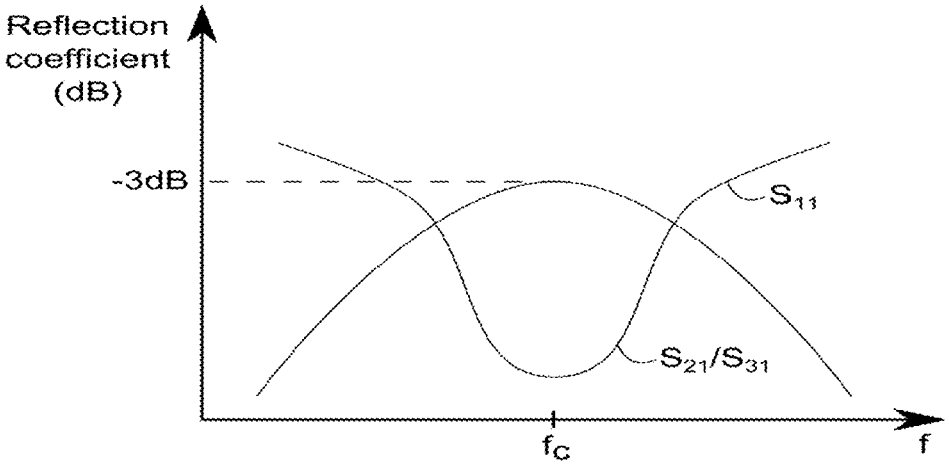
FIG. 3 illustrates a plot of the reflection coefficient for the dielectric waveguide splitter of FIG. 2 in accordance with one or more embodiments of the invention.

FIG. 3 illustrates a plot of the reflection coefficient for the dielectric waveguide splitter of FIG. 2. As illustrated, the $S_{11}$ wave is the signal from the input port, while $S_{21}/S_{31}$ are the reflective waves from the two output ports 2 and 3. Such a reflection coefficient is consistent with and similar to a typical reflection coefficient for a power divider.

Such figures illustrates that it is possible to achieve an efficient power divider with low loss. Insertion losses in a dielectric waveguide are related to its size and dielectric properties. Therefore, embodiments of the invention use a substrate with low dielectric losses (i.e. low loss tangent).

Exemplary Dielectric Ribbon

Figure 4:
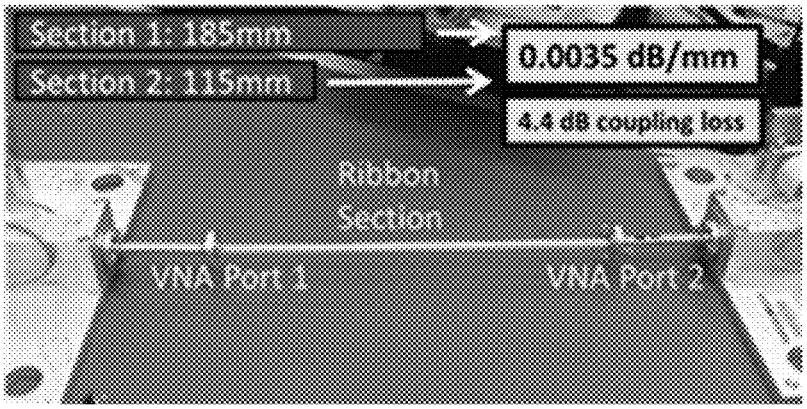
FIG. 4 illustrates the characterization of a straight ribbon section at 94 GHz using a VNA and two different lengths in accordance with one or more embodiments of the invention.

For air and space applications, an exemplary dielectric waveguide power divider 100 may utilize HDPE (high-density polyethylene) as the material for the dielectric ribbon, both for its lightweight properties as well as its relatively high melting temperature, which is necessary in more extreme environments (deep space). Additionally HDPE is 3D printing compatible which enables low-cost and large volume manufacturing. To characterize the proposed dielectric ribbon, dimensions may be optimized using any full 3D EM solver (HFSS, CST [computer simulation technology, etc.) and then several straight ribbon sections may be fabricated to characterize the insertion losses as well as coupling losses. Final dimensions selected may be 3 mm (E-plane)×1.5 mm (H-plane). Two measurements of the same dielectric ribbon with different lengths (115 mm and 185 mm) directly coupled through open WR-10 rectangular waveguide may be performed using a vector network analyzer (VNA) (HP8510). By de-embedding the length difference between the two measurements, the loss per unit length, and the coupling losses of the ribbon can be extracted from test sections. FIG. 4 illustrates the characterization of a straight ribbon section at 94 GHz using a VNA and two different lengths. Loss values are measured at 94 GHz and the coupling loss quoted (4.4 dB) is with both parts of the ribbon considered.

One additional concern that needs to be addressed, especially for aerospace applications, is interference caused by any mm-wave signal emitted from the ribbon as it may interfere with other equipment on-board, especially scientific instruments which operate in the same frequency range (radiometers or spectrometers).

Figure 5:
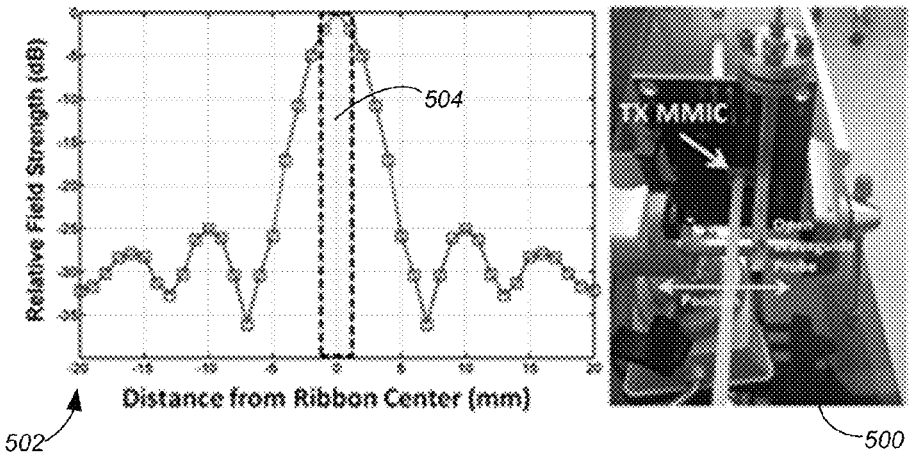
FIG. 5 illustrates the characterization of field confinement and a cross-section of a straight ribbon at 94 GHz in accordance with one or more embodiments of the invention.

To quantify any possible interference, an open ended waveguide with the flange removed may be positioned across the dielectric ribbon (as illustrated at 500 in FIG. 5). The waveguide can be connected to a W-band harmonic mixer (Agilent 11970W) and spectrum analyzer to measure the captured power. The ribbon is excited with a 100 GHz TX MMIC (a variant of [5]) while the relative power detected by the waveguide at each cross section position was recorded producing the normalized power graph 504. The physical location of the waveguide is denoted by section 504 from −2.5 to 2.5 mm.

Figure 6:
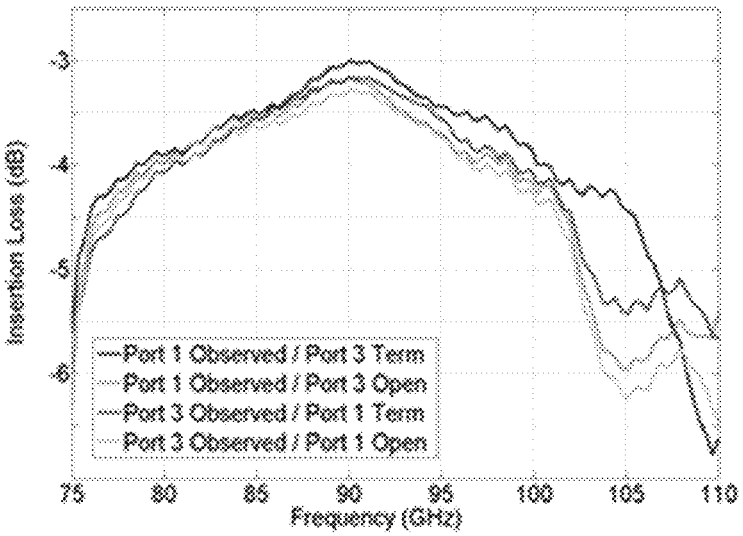
FIG. 6 illustrates a plot of measured insertion losses in accordance with one or more embodiments of the invention.

In order to obtain multi-casting operation where one transmitter can simultaneously broadcast to multiple receivers, it is necessary to incorporate a power splitter which can evenly distribute the power between multiple branches. In order to accomplish this, embodiments of the invention provide the power splitter ribbon geometry (Y junction) shown in FIG. 1, along with its electric field distribution (FIG. 2). Such a splitter/divider 100 has been optimized for minimal insertion losses. Key is that the critical angle A between the two branches remain below 90°, and smaller angles further increase splitting efficiency. The cross section W is required to be larger than $\lambda/4$ in both height and width to support the correct coupling at all ports of the power splitter 100. In the measured insertion losses plotted in FIG. 6, the coupling losses (from FIG. 4) are already de-embedded, making the ideal value 3 dB plus losses associated with the ribbon itself. In the insertion loss plot of FIG. 6, the two output ports are denoted as 1 and 3, while the excitation port is denoted as port 1. The splitter has been characterized under various termination conditions and shows excellent isolation between ports 1 and 3 (the two output ports), under both open and loaded conditions.

Figure 7:
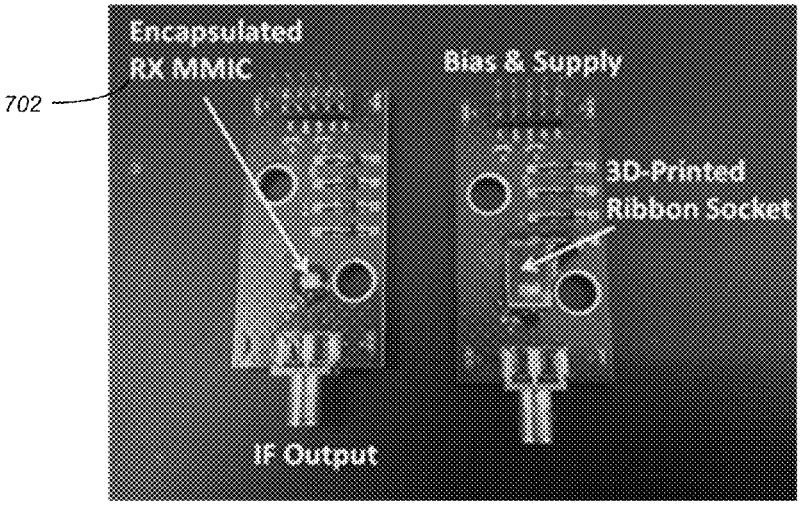
FIG. 7 illustrates a PCB assembly for a receiver in accordance with one or more embodiments of the invention.

To demonstrate the proposed dielectric ribbon multi-casting link, one may use an existing 94 GHz silicon MMICs (monolithic microwave integrated circuit) that are a lower frequency variant of those presented in [5]. The Si (silicon) MMICs are wirebonded onto PCB (printed circuit board) and contain an internal on-chip folded-dipole antenna (with total radiation efficiency ~7% [5]). For a dielectric ribbon assembly, the MMIC itself may first be encapsulated in a thin layer of epoxy to protect the widebonding as shown on the left of FIG. 7 (at 702). Then a small 3D printed socket structure is epoxied on top of the encapsulated die to accept the dielectric ribbon. The PCB contains a single header for supply and bias voltage, while an SMA (subMiniature version A) connector provides an IF (intermediate frequency) output for the Rx (receiver) (or input for the Tx [transmitter]). The PCB assembly for the Rx is shown in FIG. 7. The Tx assembly is similar. The surface mounted components provide decoupling capacitance and ESD (electrostatic discharge circuit) protection.

Figure 8:
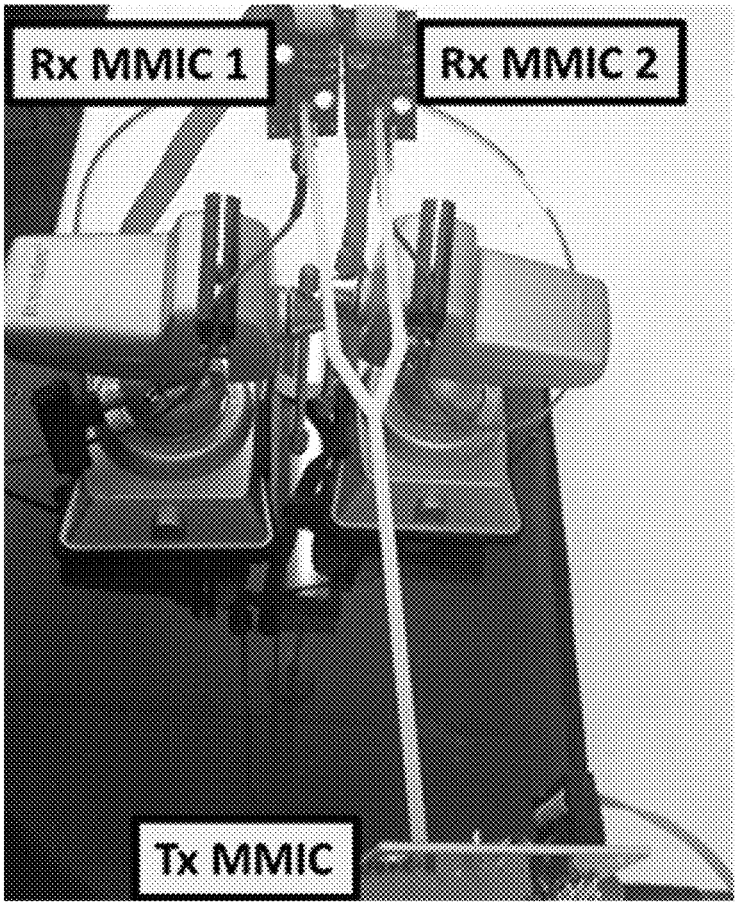
FIG. 8 illustrates a setup of a prototype multi-cast dielectric ribbon data-link in accordance with one or more embodiments of the invention.

To implement the complete prototype multi-casting link, one may construct the arrangement shown in FIG. 8 where two receiver MMICs are placed on the output ports of the power splitter, while the input port is excited with the Tx MMIC. The transmitter and receivers are then connected to a 10 BT ethernet signal source (802.3.3) between a laptop and a router in order to perform a connectivity test.

Figure 9:
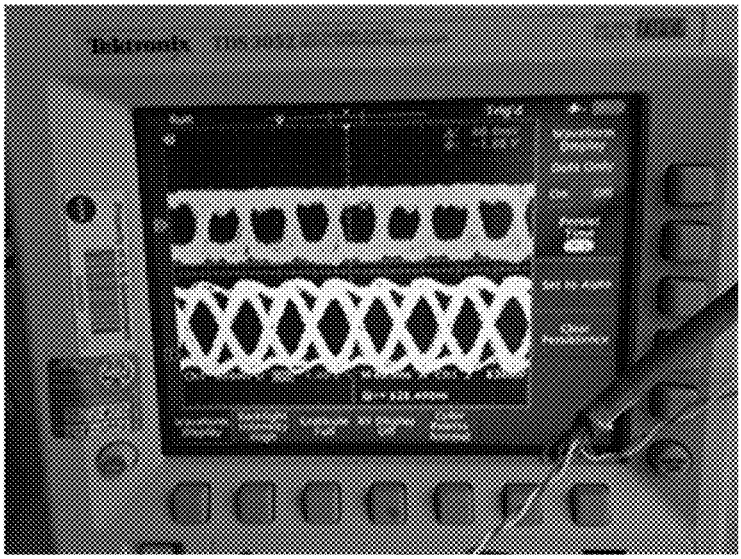
FIG. 9 shows a recorded eye-diagram as a streaming video is transferred across the ethernet-link formed by the dielectric ribbon in accordance with one or more embodiments of the invention.

FIG. 9 shows the recorded eye-diagram as a streaming video is transferred across the ethernet-link formed by the dielectric ribbon. Using the packet loss rate reported from the ethernet driver, and estimating the effects of both ethernet channel coding and error correction, the uncoded BER was estimated to be better than $10^{-12}$, which is suitable for most aircraft/spacecraft applications.

Accordingly, the losses associated with a 94 GHz dielectric ribbon data-link may be characterized using HDPE material. The proposed data-link is compatible with 3D printing processes and offers a low-cost approach to mm-wave interconnects. Further, field confinement can be shown as the propagating field is suppressed more than 30 dB at distances beyond a few cm from the ribbon. Additionally a simple Y-junction with optimized dimensions can provide balanced power splitting and enable multi-casting operation for larger network topologies. Embodiments of the invention operate reliably at 10 Mb/s with a bit error rate better than $10^{-12}$. Furthermore, a dielectric ribbon data-link does not rely on electrical contact providing higher reliability for aerospace applications.

Hybrid/Isolator for Bidirectional Link

Figure 10:
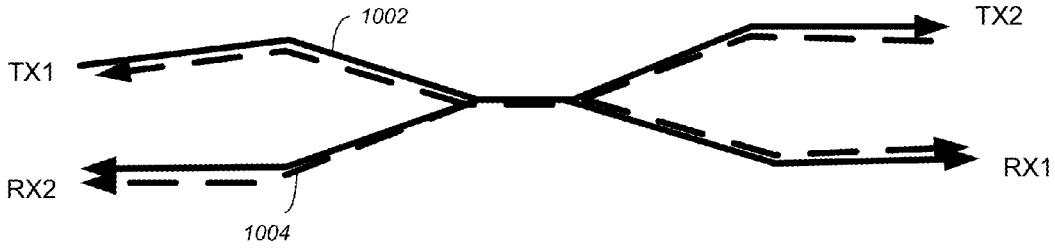
FIG. 10 (PRIOR ART)
FIG. 10 illustrates leakage/feedback resulting from a traditional configuration in accordance with the prior art.

Classically, if multiple transmitters (TXs) and a receivers (RXs) are connected on the same wire, leakage/feedback results. FIG. 10 illustrates such leakage/feedback in accordance with the prior art. The signal 1002 originating from transmitter TX1 (represented by a solid line) is transmitted to the intended receiver RX1. Similarly, the signal 1004 originating from transmitter TX2 (represented by a dashed line) is transmitted to the intended receiver RX2. Over traditional wired cabling (e.g., coaxial or other metal based systems), some leakage/feedback results such that the signal 1002 leaks or creates feedback and is received at receiver RX2 in addition to being transmitted to RX1. Similarly, signal 1004 is received at both RX2 and RX1. To separate the signals, separate chipsets and/or separate frequencies are required for the transmission.

To overcome such prior art problems, embodiments of the invention configure the dielectric waveguides Y-splitter 100 in a unique manner. More specifically, the splitter/divider 100 can be further generalized into a hybrid structure like the one shown in FIG. 11. In embodiments of the invention, a 90 degree branch can be omitted. The hybrid 1100 offers an isolated port (e.g., port 4) where the excitation power does not flow, allowing a TX and RX pair to be placed on the input (e.g., port 1) and isolated port (e.g. port 4) without self-transmission (e.g., transmission from TX to the same-node RX). This enables a dielectric waveguide link (ribbon or tube) where data signals can propagate in opposite directions at the same frequency without interference. In other words, FIG. 11 illustrates a hybrid structure that enables simultaneous bidirectional communication on a dielectric waveguide at a single frequency through geometric manipulation of the signal to prevent self-transmission.

Figure 12:
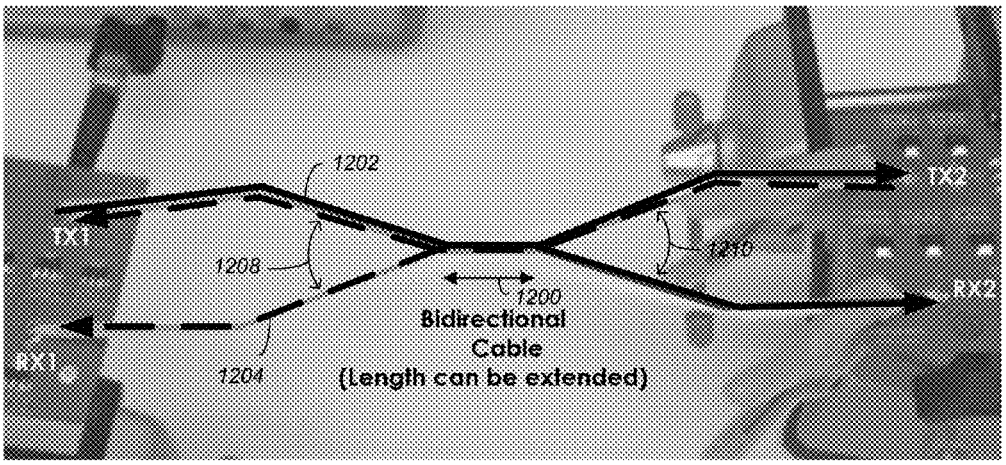
FIG. 12 shows a demonstration setup of a bidirectional link in accordance with one or more embodiments of the invention.

FIG. 12 shows a demonstration setup of this bidirectional link where the bidirectional section 1200 of the cable can be extended to any desired length. As illustrated, a first signal 1202 (represented by a solid line) originates from TX1, while a second signal 1204 (represented by a dashed line) originates from TX2 forming a fully bidirectional link 1200 in the middle. This bidirectional cable section 1200 can be extended up to many meters, allowing a single frequency, bidirectional dielectric waveguide data link.

Figure 11:
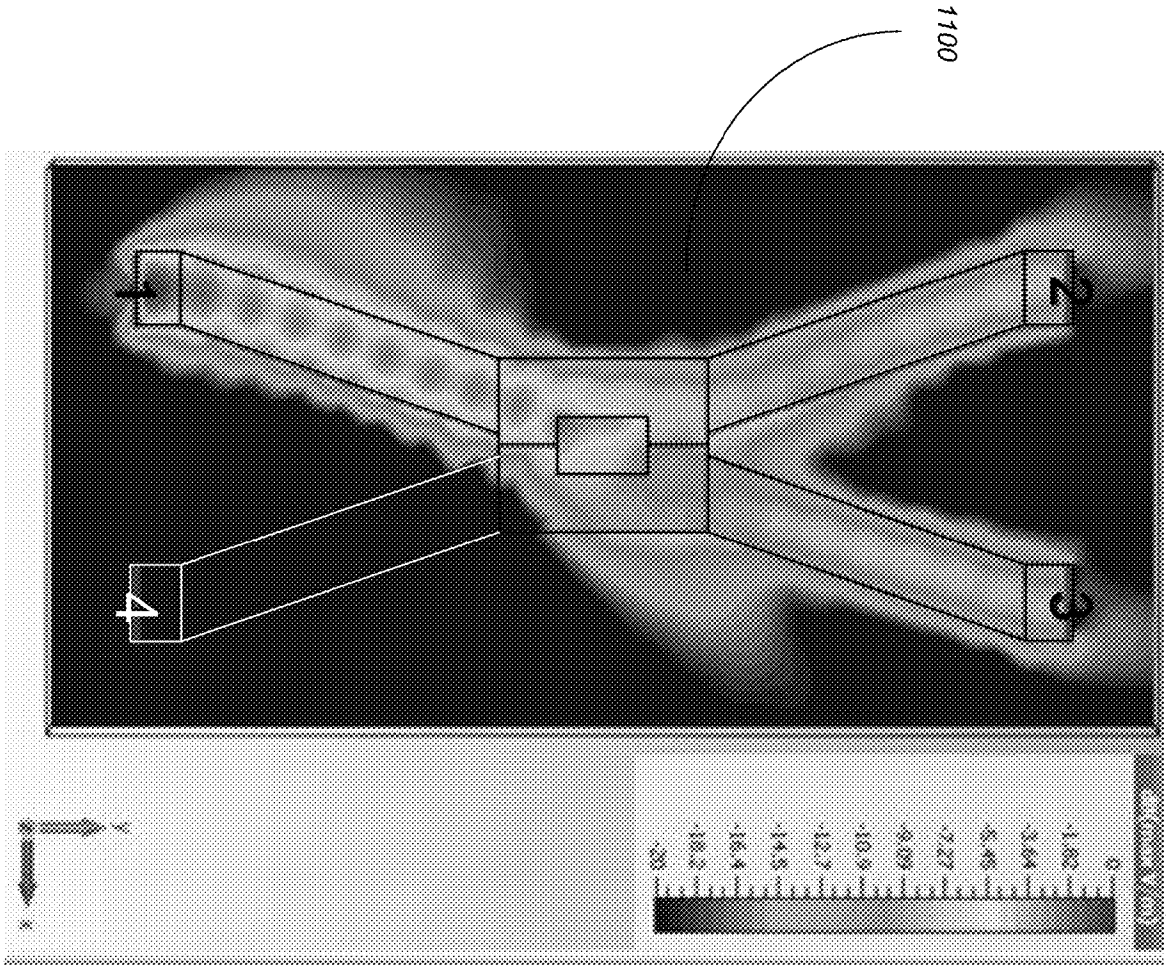
FIG. 11 illustrates a hybrid structure that enables simultaneous bidirectional communication on a dielectric waveguide at a single frequency through geometric manipulation of the signal to prevent self-transmission.

As illustrated in FIGS. 11 and 12, the dielectric waveguide Y-junction power divider may simply be configured in a back-to-back configuration to enable the bi-directional cable without leakage/feedback. In this regard, one of the properties of a mm-wave (e.g., from 30 GHz to 300 GHz) is that such signals won't propagate around a corner of a dielectric substrate. By configuring the Y-junction utilizing angles 1208-1210 less than 90°, the mm-wave signals will not propagate to the receiver on the same port thereby reducing/eliminating leakage/feedback.

System Overview

As described above, embodiments of the invention provide a dielectric waveguide based power splitter that enables multi-cast operation and multi-listen. Further, a hybrid/isolator component allows for simultaneous bidirectional communication on a single dielectric waveguide cable.

A dielectric waveguide splitter is provided/fabricated. More specifically, a dielectric substrate is fabricated into a first Y-junction waveguide with a first port splitting into a first branch leading to a second port and a second branch leading to a third port. An angle between the first branch and the second branch is below ninety degrees (90°). Such a configuration enables millimeter-wave (mmWave) transmission between the first port and the second port while reducing feedback of the mmWave between the second and third port. In particular, a dimension of the waveguide splitter (e.g., including the angle) enables the splitter to reduce the feedback to below a desired threshold range (e.g., below 1% or 20 dB). An additional dimension that enables the functionality of the device is the sizing of the waveguide. In particular, a cross section of the Y-junction waveguide is larger than $\lambda/4$ in both height and width.

While the dielectric substrate may comprise any type of substrate with low dielectric losses (e.g., in the range of 2.0 to 3.0), in one or more embodiments of the invention, the dielectric substrate consists essentially of a plastic substrate.

Multicasting may be performed where the first port multicasts a signal to both the second port and to the third port. Further, simultaneous bidirectional communication in opposite directions at a single frequency between the first port and the second port and third ports may be enabled.

A dielectric waveguide bidirectional link may also be fabricated. In such an embodiment, a dielectric substrate may be fabricated into a first Y-junction waveguide and a second Y-junction waveguide that share a bidirectional waveguide section. A first port on the first Y-junction waveguide leads to a first branch that leads to the bidirectional waveguide section. A second port on the second Y-junction waveguide leads to a second branch that leads to the bidirectional waveguide section. A third port on the second Y-junction leads to a third branch that leads to the bidirectional waveguide section. An angle between the second branch and the third branch is below ninety degrees (90°). Further, the above described configuration (including use of particular angles/sizing) enables simultaneous bidirectional mmWave transmission at a single frequency between the first port and the second port, and between the first port and the third port while reducing feedback of the mmWave between the second and third port.

Similar to the waveguide splitter, in the dielectric waveguide bidirectional the dielectric substrate may be any type of substrate with low dielectric losses and may consist essentially of a plastic substrate.

With respect to the bidirectional communications, the first port transmits a first signal that is received by both the second port and the third port. In addition, the second port transmits, simultaneously with the first signal, a second signal that is received by the first port. Similar to the splitter, a cross section of the first Y-junction waveguide and the second Y-junction waveguide is larger than λ/4 in both height and width. In addition, a fourth port on the first Y-junction may lead to a fourth branch that leads to the bidirectional waveguide section. Such a fourth port on the first Y-junction waveguide is isolated to enable a transmission and receiver pair to be placed on the first port and the fourth port without self-transmission.

To utilize the bidirectional link an a particular environment/communication system, the link may take a variety of forms including a ribbon and/or a tube.

Conclusion

This concludes the description of the preferred embodiment of the invention. In summary, embodiments of the invention provide a dielectric waveguide-based power divider and hybrid/isolator. Embodiments of the invention may be used for communication links between modules on spacecraft, landers, and rovers. Dielectric waveguide technology also provides a low weight, size, and power approach to Gb/s interconnects. For example, embodiments of the invention may be utilized as part of the communication electronics/communication systems in the data-center, server, and desktop markets. Such data-links also offer improved reliability and reduced packaging complexity as they do not depend on physical contact, which allows for added vibration/stress immunity.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

REFERENCES

[1] A. Natarajan, et. al, "A Fully-Integrated 16-Element Phased-ArrayReceiver in SiGeBiCMOS for 60-GHz Communications" IEEE Journal of Solid-State Circuits, Vol. 46, No 5, p 1059-1075, May 2011.

[2] T. Mitomo, et. al, "A 2 Gb/s-Throughput CMOS Transceiver Chipset with In-Package Antenna for 60 GHz Short-Range wireless Communication", Proc. International Solid-State Circuits Conference 2012, p 266-267.

[3] R. F Weiser, et al. "A 60 GHz CMOS phased-array transceiver pair for multi-Gb/s wireless communications" International Solid-State Circuits Conference 2011, p 164-166.

[4] Y. Hino et al. "A versatile multi-modality serial link", International Solid-State Circuits Conference 2012, p 332-334.

[5] Y. Kim, et al. "An 8 Gb/s/pin 4pJ/b/pin Single-T-Line dual (base+RF) band simultaneous bidirectional mobile memory I/O interface with inter-channel interference suppression", International Solid-State Circuits Conference 2012, p 50-52.

[6] A. Tang et al. "A 155 GHz 220 mW Synthesizer-Free Phase Based Radar System in 65 nm CMOS Technology", IEEE International Microwave Symposium 2013.

What is claimed is:

1. A dielectric waveguide splitter comprising:

a dielectric substrate fabricated into a first Y-junction waveguide with a first port splitting into a first branch leading to a second port and a second branch leading to a third port, wherein:

an angle between the first branch and the second branch is below ninety degrees (90°); and the dielectric waveguide splitter enables millimeter-wave (mmWave) transmission between the first port and the second port while reducing feedback of the mmWave between the second and third port.

2. The dielectric waveguide splitter of claim 1, wherein the dielectric substrate consists essentially of a plastic substrate.

3. The dielectric waveguide splitter of claim 1, wherein: the first port multi-casts a signal to both the second port and to the third port.

4. The dielectric waveguide splitter of claim 1, wherein: the dielectric waveguide splitter enables simultaneous bidirectional communication in opposite directions at a single frequency between the first port and the second port and third ports.

5. The dielectric waveguide splitter of claim 1, wherein: a cross section of the Y-junction waveguide is larger than λ/4 in both height and width.

6. A dielectric waveguide bidirectional link comprising:

a dielectric substrate fabricated into a first Y-junction waveguide and a second Y-junction waveguide that share a bidirectional waveguide section, wherein:

a first port on the first Y-junction waveguide leads to a first branch that leads to the bidirectional waveguide section;

a second port on the second Y-junction waveguide leads to a second branch that leads to the bidirectional waveguide section;

a third port on the second Y-junction leads to a third branch that leads to the bidirectional waveguide section;

an angle between the second branch and the third branch is below ninety degrees (90°); and the dielectric waveguide bidirectional link enables simultaneous bidirectional millimeter-wave (mmWave) transmission at a single frequency between the first port and the second port, and between the first port and the third port while reducing feedback of the mmWave between the second and third port.

7. The dielectric waveguide bidirectional link of claim 6, wherein the dielectric substrate consists essentially of a plastic substrate.

8. The dielectric waveguide bidirectional link of claim 6, wherein:

the first port transmits a first signal that is received by both the second port and the third port; and the second port transmits, simultaneously with the first signal, a second signal that is received by the first port.

9. The dielectric waveguide bidirectional link of claim 6, wherein:

a cross section of the first Y-junction waveguide and the second Y-junction waveguide is larger than λ/4 in both height and width.

10. The dielectric waveguide bidirectional link of claim 6, wherein:

a fourth port on the first Y-junction leads to a fourth branch that leads to the bidirectional waveguide section; and the fourth port on the first Y-junction waveguide is isolated to enable a transmission and receiver pair to be placed on the first port and the fourth port without self-transmission.

11. The dielectric waveguide bidirectional link of claim 6, wherein:

the dielectric waveguide bidirectional link comprises a ribbon.

12. The dielectric waveguide bidirectional link of claim 6, wherein:

the dielectric waveguide bidirectional link comprises a tube.

13. A method for fabricating a dielectric waveguide bidirectional link comprising:

fabricating a dielectric substrate into a first Y-junction waveguide and a second Y-junction waveguide that share a bidirectional waveguide section, wherein:

a first port on the first Y-junction waveguide leads to a first branch that leads to the bidirectional waveguide section;

a second port on the second Y-junction waveguide leads to a second branch that leads to the bidirectional waveguide section;

a third port on the second Y-junction leads to a third branch that leads to the bidirectional waveguide section;

an angle between the second branch and the third branch is below ninety degrees (90°); and the dielectric waveguide bidirectional link enables simultaneous bidirectional millimeter-wave (mmWave) transmission at a single frequency between the first port and the second port, and between the first port and the third port while reducing feedback of the mmWave between the second and third port.

14. The method of claim 13, wherein the dielectric substrate consists essentially of a plastic substrate.

15. The method of claim 13, wherein:

the first port transmits a first signal that is received by both the second port and the third port; and the second port transmits, simultaneously with the first signal, a second signal that is received by the first port.

16. The method of claim 13, wherein:

a cross section of the first Y-junction waveguide and the second Y-junction waveguide is larger than λ/4 in both height and width.

17. The method of claim 13, wherein:

a fourth port on the first Y-junction leads to a fourth branch that leads to the bidirectional waveguide section; and the fourth port on the first Y-junction waveguide is isolated to enable a transmission and receiver pair to be placed on the first port and the fourth port without self-transmission.

18. The method of claim 13, wherein:

the dielectric waveguide bidirectional link comprises a ribbon.

19. The method of claim 13, wherein:

the dielectric waveguide bidirectional link comprises a tube.

* * * * *